US012796756B2

(12) United States Patent
Chen

(10) Patent No.: US 12,796,756 B2
(45) Date of Patent: Nov. 17, 2026

(54) HEATING SHAWL

(71) Applicant: JingWeiLianHe (Hong Kong) Technology Co., Limited, Central (HK)

(72) Inventor: Xin Chen, Central (HK)

(73) Assignee: JingWeiLianHe (Hong Kong) Technology Co., Limited, Central (HK)

( * ) Notice: Subject to any disclaimer, the term of this patent is extended or adjusted under 35 U.S.C. 154(b) by 0 days.

(21) Appl. No.: 19/559,677

(22) Filed: Mar. 6, 2026

(65) Prior Publication Data

US 2026/0191286 A1 Jul. 9, 2026

Related U.S. Application Data

(63) Continuation-in-part of application No. 18/828,187, filed on Sep. 9, 2024.

(51) Int. Cl.
*A41D 27/20* (2006.01)
*A41D 23/00* (2006.01)

(52) U.S. Cl.
CPC ..... *A41D 27/20* (2013.01); *A41D 23/00* (2013.01); *A41D 2400/12* (2013.01); *A41D 2400/322* (2013.01)

(58) Field of Classification Search
CPC ..... A41D 13/005; A41D 13/002; A41D 13/0512; A41D 13/0051; A41D 23/00;
(Continued)

(56) References Cited

U.S. PATENT DOCUMENTS 3,053,250 A * 9/1962 Stubbs ..... A61H 23/0218 601/79
4,979,502 A * 12/1990 Hunt ..... A61H 23/02 601/79

(Continued)

FOREIGN PATENT DOCUMENTS

CN 203735515 U * 7/2014
CN 205494358 U * 8/2016

(Continued)

OTHER PUBLICATIONS

Amazon.com Listing for Graphene-Infused 1Min Fast Heating Pad, with first available date Sep. 5, 2024, retrieved at https://www.amazon.com/Lenmen-Graphene-Infused-Weighted-Shoulders-Christmas/dp/B0DG5DRZWD/ on Jun. 26, 2025. (Year: 2024).*

(Continued)

*Primary Examiner* — F Griffin Hall
(74) *Attorney, Agent, or Firm* — RAYCHAN PATENT FIRM; Raymond Y Chan

(57) ABSTRACT

Disclosed is a heating shawl, comprising a shawl body, a heating element, and heat-conducting patterns on a contact surface for diffusing heat and evening out temperature. The contact surface is provided with at least one pocket-type mounting structure, each comprising a mounting groove and a mounting cover, with magnetic positioning components inside the groove. A massage module is placed through an opening and then magnetically positioned and limited to prevent loosening and detachment, reduce protrusion, minimize friction and foreign matter ingress, enhancing fit and appearance smoothness.

20 Claims, 11 Drawing Sheets

(58) Field of Classification Search
CPC .... A41D 27/02; A41D 27/201; A41D 27/202; A41D 27/204; A41D 27/205; A41D 27/207; A41D 27/208; A41D 2400/10; A41D 2400/12; A41D 2400/322; A61F 2007/0233; H05B 2203/036; H05B 3/342; H05B 3/345; H05B 3/347
See application file for complete search history.

(56) References Cited

U.S. PATENT DOCUMENTS

| | | | | | |
|---|---|---|---|---|---|
| 5,235,967 | A * | 8/1993 | Arbisi | A61H 23/0218 | 601/108 |
| 6,193,678 | B1 * | 2/2001 | Brannon | A61H 23/0263 | 601/79 |
| 6,329,638 | B1 * | 12/2001 | Bloodworth | A61H 23/02 | 601/18 |
| 7,147,610 | B2 * | 12/2006 | Maalouf | A61H 23/02 | 601/79 |
| 7,207,953 | B1 * | 4/2007 | Goicaj | A61H 23/02 | 601/134 |
| 8,012,109 | B1 * | 9/2011 | Lather, Sr. | A61H 15/0078 | 601/79 |
| 10,039,692 | B2 * | 8/2018 | Nickelson | A61H 1/008 | |
| 10,441,743 | B1 * | 10/2019 | McKamy | A41B 13/00 | |
| 11,839,244 | B1 * | 12/2023 | Jorden | A41D 1/06 | |
| 12,220,372 | B2 * | 2/2025 | Sistrunk | A61H 23/02 | |
| 2004/0133133 | A1 * | 7/2004 | Dreimann | A61H 23/0263 | 601/70 |
| 2004/0260211 | A1 * | 12/2004 | Maalouf | A61H 23/02 | 601/70 |
| 2021/0059332 | A1 * | 3/2021 | Fernandez | A61H 23/0263 | |

FOREIGN PATENT DOCUMENTS

| | | | | | |
|---|---|---|---|---|---|
| CN | 107157643 | A | * | 9/2017 | A61H 23/02 |
| CN | 207023297 | U | * | 2/2018 | |
| CN | 212814331 | U | * | 3/2021 | |
| CN | 214710479 | U | * | 11/2021 | |
| KR | 20100109612 | A | * | 10/2010 | A61H 9/0078 |
| KR | 102370625 | B1 | * | 3/2022 | A41D 27/205 |

OTHER PUBLICATIONS

Amazon.com Listing for Graphene-Infused Heating Pad 3X, with first available date Aug. 25, 2023, retrieved at https://www.amazon.com/Lenmen-Graphene-Infused-Weighted-Shoulders-Christmas/dp/B0CGM2SWK2/ on Jun. 26, 2025. (Year: 2023).*

* cited by examiner

HEATING SHAWL

CROSS-REFERENCE TO RELATED APPLICATIONS

This application is a continuation-in-part of U.S. patent application Ser. No. 18/828,187, filed on Sep. 9, 2024, the content of which and the amendments thereof, is incorporated herein by reference in its entirety.

TECHNICAL FIELD

The present disclosure relates to a shawl, and particularly to a heating shawl.

BACKGROUND

Existing heating shawls typically incorporate heating elements inside the shawl body, with heating areas preset at fixed positions such as the shoulder part, neck part, or back, providing warmth through electrical heating. In such structures, the heating module is usually singular, and the heating positions are predetermined during product design, resulting in relatively fixed heat distribution and location. This makes it difficult to adapt flexibly to different users' body shapes, worn states, and functional needs. Furthermore, if additional functions like massage are desired on a heating shawl, existing solutions often involve setting pockets on a contact surface to accommodate detachable functional modules. However, in such designs, the functional modules are usually located on the surface of the contact area or protrude locally, which may lead to displacement or loosening due to bending during wear, movement, or fabric deformation, causing unstable positioning. On the other hand, protruding structures disrupt the fit between the contact surface and the body, creating local gaps or "air pockets" between the fixed heating area and the body, thereby reducing heat transfer efficiency. This results in insufficient local warmth, decreased comfort, and compromised synergy between heating and additional functions. Therefore, in heating shawl structures with a singular heating module and fixed heating positions, achieving stable placement of additional functional modules while minimizing their impact on the flatness, fit, and heat transfer effectiveness of the contact surface has become a technical problem urgently needing resolution in the field.

SUMMARY

The present disclosure provides a heating shawl to address the issue raised in the background art where heating shawls cannot distribute heat evenly.

To solve the above problem, the present disclosure adopts the following technical solutions:

The present disclosure provides a heating shawl, including a shawl body, comprising a contact surface for contacting and releasing heat to a human body part; and a mounting part disposed on the contact surface, including: at least one mounting groove, each recessed inward from the contact surface, forming an accommodating space inside, with a massage module accommodated in the accommodating space; and a fastener correspondingly disposed in the mounting groove for fixing the massage module in the accommodating space;

the massage module is configured to be partially accommodated in the mounting groove when placed into the accommodating space and fixed by the fastener in the accommodating space, so that the massage module does not protrude from the contact surface.

The present disclosure further provides a heating shawl, including a shawl body, including a contact surface for contacting a human body part and a heating element for generating heat, the heating element being capable of transferring the generated heat to the contact surface; a mounting part disposed on the contact surface, including at least one mounting groove; and the at least one mounting groove, each recessed inward from the contact surface, forming an accommodating space inside, with a massage module accommodated in the accommodating space;

the massage module is configured such that when placed into the accommodating space, the massage module is at least partially accommodated within the mounting groove and does not protrude beyond the contact surface.

Figure 1:
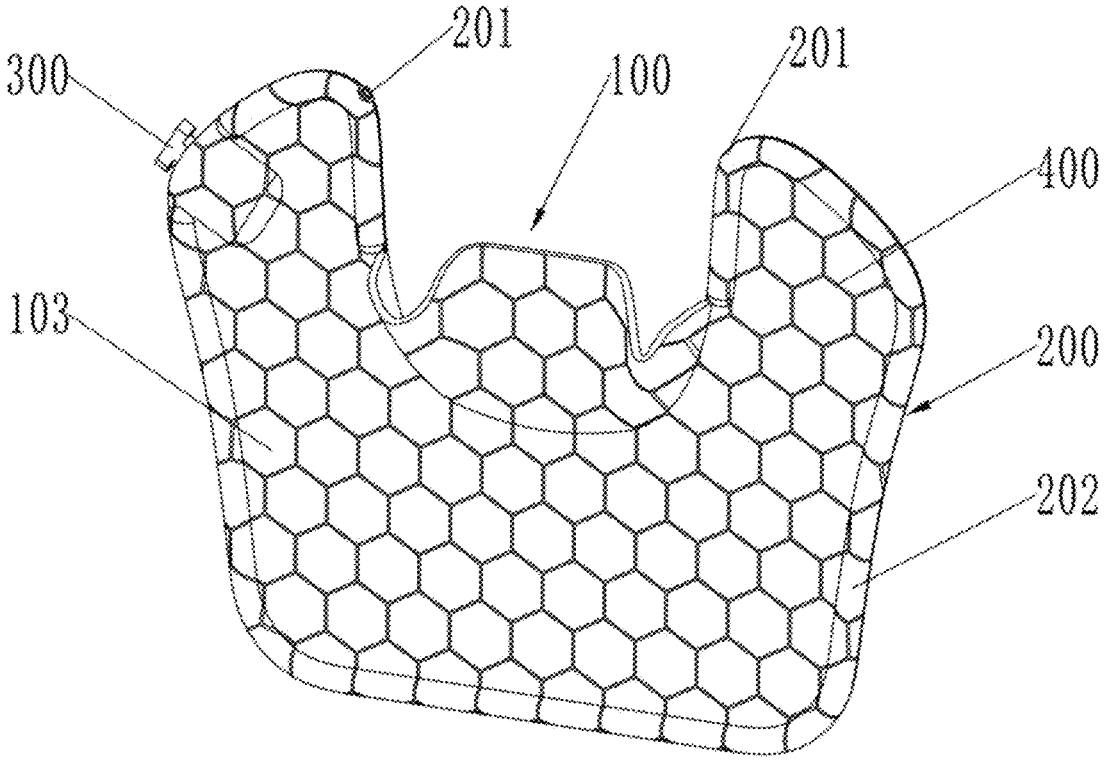
FIG. 1 is a schematic perspective view of the unfolded state of the present disclosure.

The meanings of the attached markings are as follows: Shawl Body (100); Shoulder Part (101); Neck Part (102); Contact Surface (103); Magnetic Component (104); Upright Pocket (105); Inverted Pocket (106); Opening (107); Controller (108); Control Button (109); Mounting Groove (110); Cover Member (111); Hook-And-Loop Fastener Assembly (112); Display Screen (116); Back Side (117); Storage Bag (118); Counterweight Structure (200); First Connector (201); Connecting Part (202); Counterweight (203); Data Cable (204); Second Connector (205); Power Supply Interface (300); Heat-Conducting Pattern (400); Heating Element (500); Sensing Module (600); Massage Module (700).

DESCRIPTION OF EMBODIMENTS

Embodiment 1

As shown in FIGS. 1 to 5, the present disclosure provides a heating shawl, including a shawl body 100. The shawl body 100 includes a shoulder part 101 (see the dashed portion in FIG. 2) and a neck part 102. The side of the shoulder part 101 and neck part 102 that contacts the human body is defined as a contact surface 103, on which a heat-conducting pattern 400 is provided. A heating element 500 is arranged inside the shawl body 100. A hem of the shoulder part 101 is provided with a counterweight structure 200, which includes a hollow connecting part 202 and a counterweight 203 filled inside the connecting part.

Figure 11:
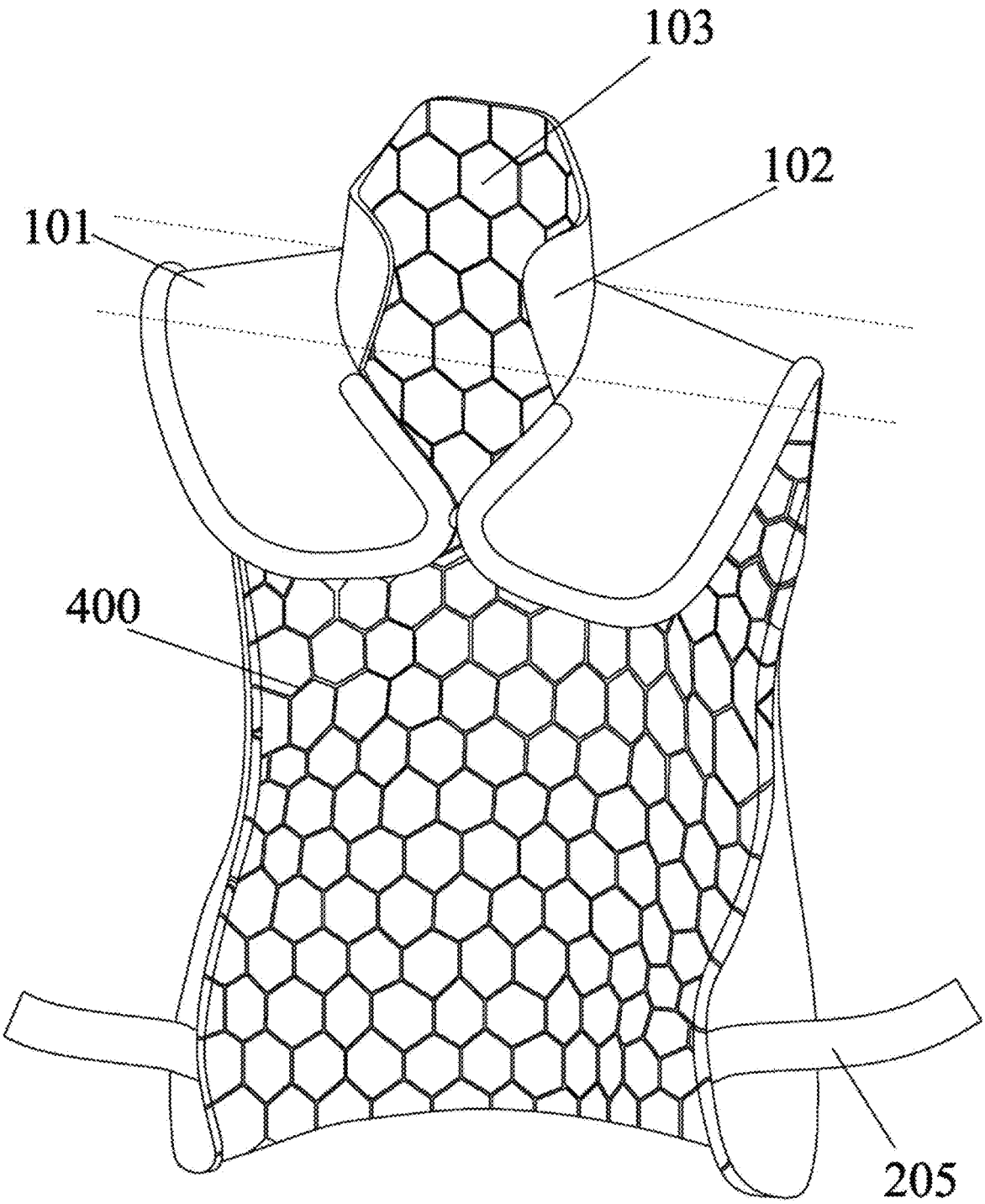
FIG. 11 is a schematic diagram of the extended version of the embodiment shown in FIG. 1 of the present disclosure.

Referring to FIG. 11, the length of the shawl body 100 along the direction of the human back is a fixed specification preset during manufacturing, and the length may be selected as different models or size versions during the product design and production stages. Specifically, the shawl body 100 may be made in a conventional length specification to cover the shoulder part 101 and the adjacent area of the neck part 102 of the human body; it may also be made in an extended specification along the back direction, allowing the shawl body 100 to extend downward from the shoulder part 101 and cover the upper back and middle back of the human body, preferably further covering the entire back area of the human body, to meet heating usage needs for different coverage ranges.

As shown in FIG. 1, in this embodiment, the shoulder part 101 includes a first connector 201.

In an embodiment, the first connector 201 includes a male snap and a female snap, achieving connection through the two interlocking components. The male buckle has a protruding part, while the female buckle has a corresponding groove or hole. By aligning the male buckle with the groove or hole of the female buckle and pressing, the connection is realized. Similarly, disconnection only requires pulling apart. Once buckled, the first connector 201 enables the shawl to be secured at the shoulder, ensuring the shawl does not become loose or fall off, maintaining a certain temperature.

In another embodiment of the first connector 201 (not shown), the first connector 201 may also be two magnets, with shapes including but not limited to at least one of circular, rectangular, polygonal, oval, or irregular structures. The two magnets are respectively arranged at the hem edges on both sides of the shawl shoulder part 101, with their positions corresponding to each other, and are configured to approach each other and engage magnetically in the shawl's worn state, achieving a detachable closed connection in the shoulder area of the shawl. In terms of positional relationship, the N pole of one magnet faces the S pole of the other magnet, allowing them to automatically and quickly adhere when brought gently close together. This non-contact connection method avoids physical wear caused by frequent fastening and unfastening, thereby extending the shawl's service life. Additionally, the connection of the two magnets does not generate noise.

In another embodiment of the first connector 201 (not shown), the first connector 201 may also be hook-and-loop fasteners, specifically the loop side and the hook side. The loop side is arranged at the hem edges on both sides of the shawl shoulder part 101, and the hook side is arranged on the opposite side of the shoulder part 101; adhesion of the loop side and hook side achieves connection of the shoulder part. The hook-and-loop connection is simple and quick, offers good wear resistance and durability, withstands multiple openings and closings without damage, and allows adjustment of the connection position between the loop and hook sides to meet different usage needs.

In another embodiment (not shown), the shawl body 100 is provided with first connectors on both sides of the opening at the neck part 102. The first connectors are configured to connect the edge portions on both sides of the opening at the neck part 102 in the worn state, forming a detachable closed or semi-closed structure. This structure helps improve the fit of the shawl in the neck area, reduces heat loss in this area, and enhances comfort during use. The first connector is able to be implemented in various forms, such as at least one of snap fasteners, magnets, hook-and-loop fasteners, ties, or clamping members. In a preferred implementation, the first connector is an elastic clamping member independently arranged from the shawl body 100. This clamping member is able to move along the edge of the opening at the neck part 102 and be fixed at different positions, thereby adjusting the tightness of the opening. For example, the clamping member can cooperate with the shawl edge through sliding rails, multiple snap points, or elastic deformation to allow adjustment of the clamping position.

As shown in FIGS. 1 to 5, in this embodiment, a heating element 500 is arranged inside the shawl body 100, which can output a stable temperature. A power supply interface 300 is provided on the shoulder part 101, and the heating element 500 is electrically connected to the power supply interface 300. The power supply interface 300 is positioned at an easily accessible location on the shoulder part 101, facilitating charging at any time during use and ensuring the continuous operation of the heating shawl.

In other embodiments (not shown), a thermal channel is arranged inside the shawl body 100. The thermal channel is evenly laid throughout the interior of the shawl body 100 and adopts a hollow structure capable of containing a thermally conductive gel, thereby achieving the heating function of the shawl. A gel inlet is provided on the left side of the shoulder part 101, and a gel outlet is provided on the right side of the shoulder part 101. A driving device connected to the gel inlet and/or gel outlet provides circulating power, enabling the thermally conductive gel to flow cyclically, continuously passing through the thermal channel to keep the shawl at a suitable temperature.

Specifically, referring to FIG. 11, a second connector 205 may also be provided on the shawl body 100. The second connector 205 is preferably a strap, and the straps can be fastened together to gather and secure the shawl body 100, thereby improving its fit to the human body, reducing the likelihood of the shawl body 100 becoming loose or displaced during use, minimizing heat loss at the opening, and enhancing heating performance.

Figure 2:
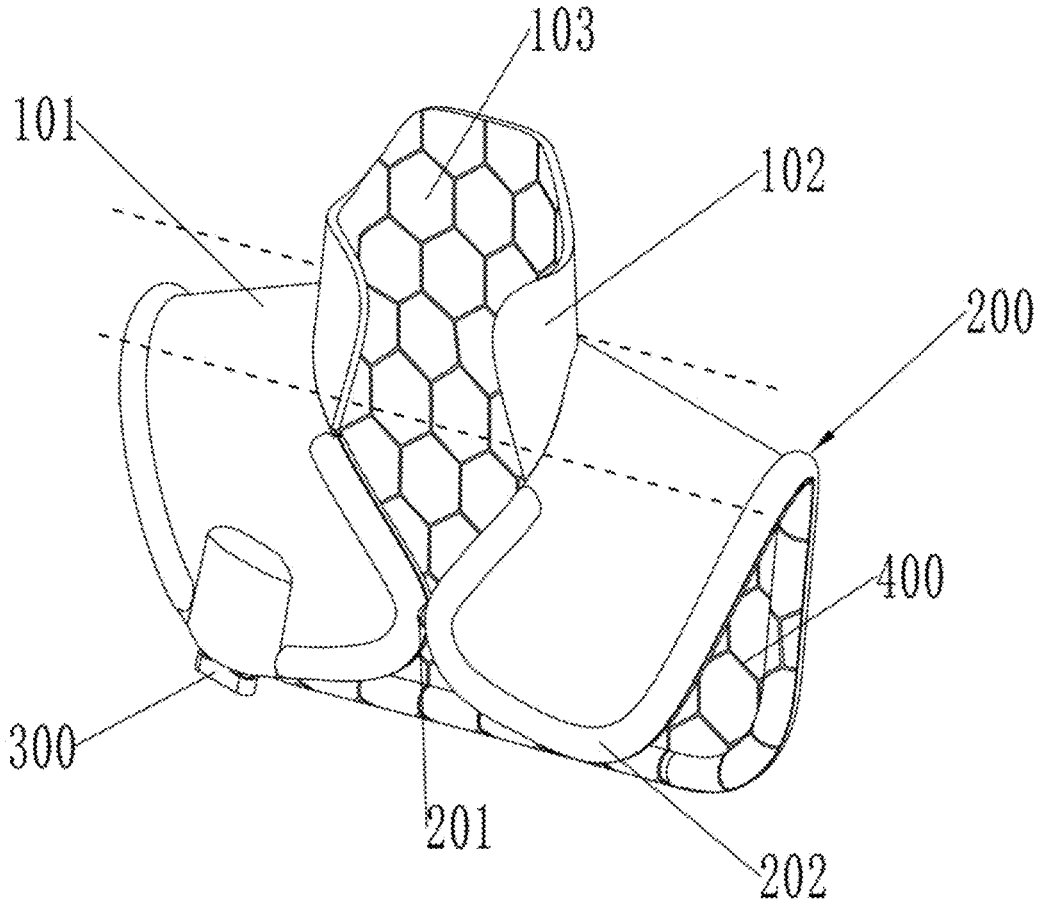
FIG. 2 is a schematic perspective view of the fastened state of the present disclosure.

As shown in FIGS. 1 to 2, in this embodiment, the shawl body 100 includes a shoulder part 101 and a neck part 102. The shoulder part 101 and the neck part 102 are of an integrated structure, transitioning naturally to conform to the contours of the human body. The shoulder part 101 is relatively broad, covering and wrapping the entire shoulder, while the neck part 102 is relatively slender, encircling the neck to provide warmth. The side of the shoulder part 101 and neck part 102 that directly contacts the human body is referred to as the contact surface 103.

In this embodiment, the contact surface 103 is made of plush material. The fibers of the plush material are fine and fluffy, capable of forming an air layer that effectively insulates against external cold. Additionally, its good elasticity and adaptability allow the shawl to conform to the curves of the body, reducing air convection and thereby enhancing the heating effect.

In other embodiments (not shown), the materials of the contact surface 103 on the shoulder part 101 and neck part 102 are imitation cashmere, polar fleece, and microfiber. Imitation cashmere is smooth, soft, elastic, rich in color, low-cost, easy to care for, and provides a comfortable touch. Polar fleece is lighter in weight, has strong warmth retention, a soft texture, and offers good breathability and moisture-wicking. Microfiber has excellent softness and warmth, can quickly absorb and release moisture to keep the skin dry, and is wear-resistant and wrinkle-resistant.

Figure 3:
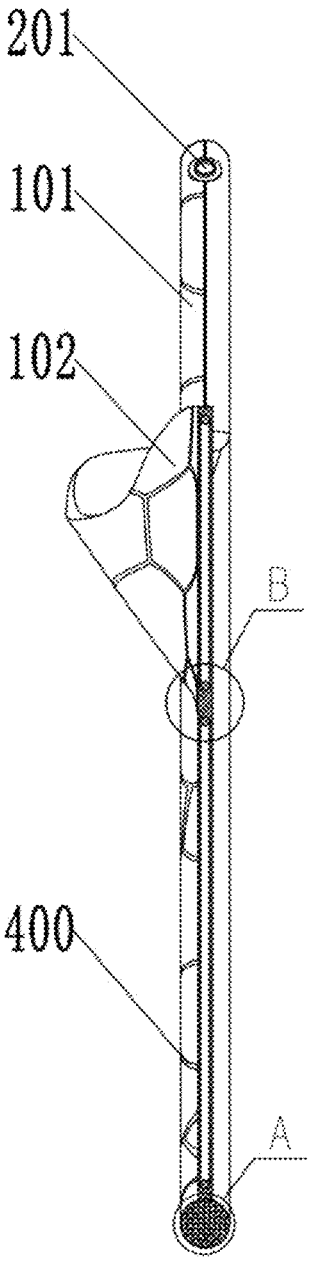
FIG. 3 is a schematic cross-sectional view taken along the thickness direction of the shawl body shown in FIG. 1 of the present disclosure.
Figure 4:
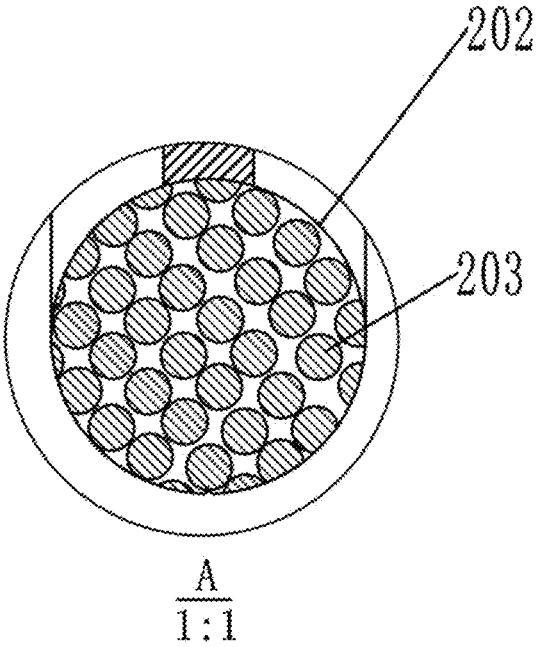
FIG. 4 is an enlarged schematic view of section A in FIG. 3 of the present disclosure.
Figure 5:
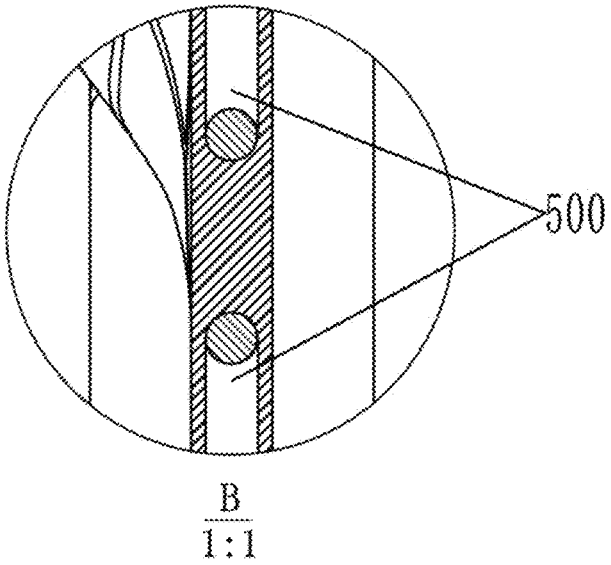
FIG. 5 is an enlarged schematic view of section B in FIG. 3 of the present disclosure.
Figure 6:
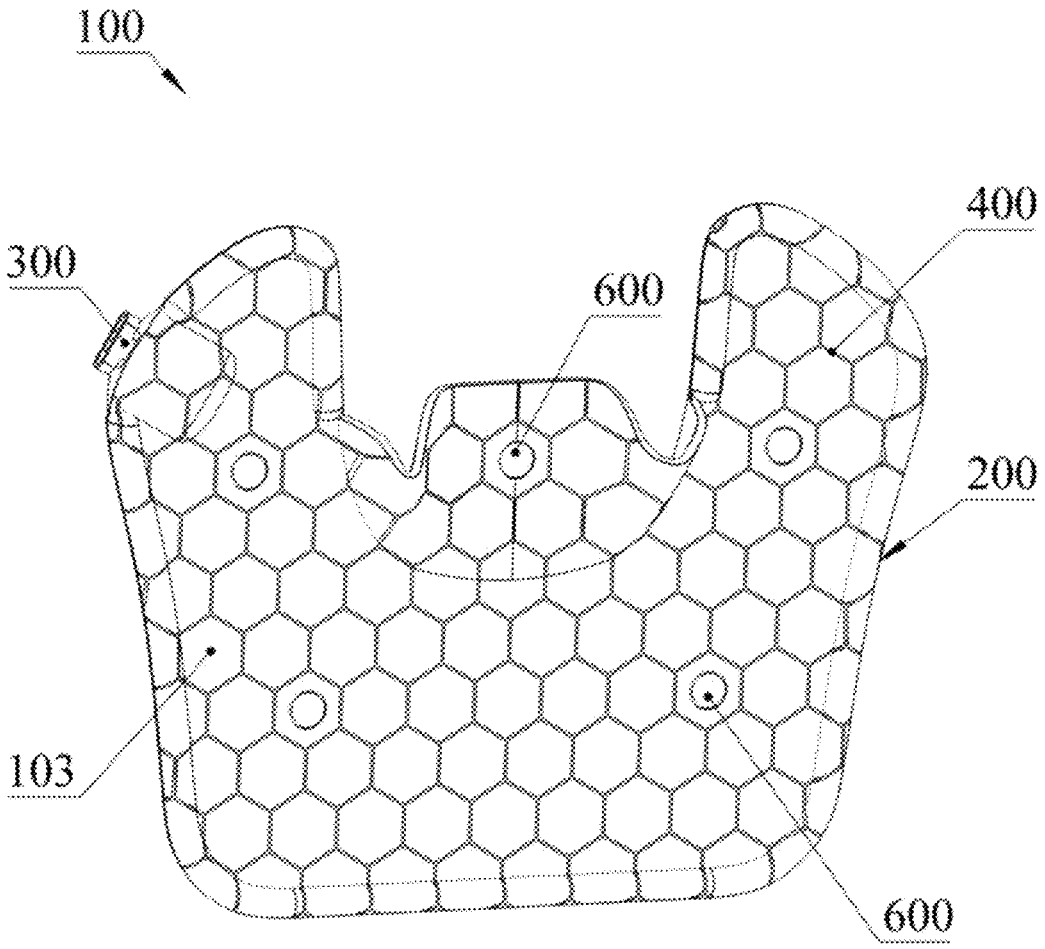
FIG. 6 is a schematic structural view of the sensing module in the present disclosure.

As shown in FIGS. 2 to 4, in this embodiment, the heating shawl includes a counterweight structure 200, and the counterweight structure 200 includes a connecting part 202 and a counterweight 203.

By providing the counterweight structure 200, during the use of the heating shawl, the hem of the shoulder part 101 is kept vertical and in contact with the human body, ensuring that the contact surface 103 is able to fit closely to the body, thereby enhancing the thermal therapy effect of the heating shawl.

In this embodiment, the shawl body 100 and the connecting part 202 are integrally formed, making the entire heating shawl more compact. Additionally, the heat-conducting pattern 400 of the heating shawl uniformly covers the contact surface 103, not only improving heat conduction efficiency but also ensuring more even heat distribution.

In this embodiment, the heating shawl uses graphene material to form the heat-conducting pattern 400. Graphene is a nanomaterial with strong thermal performance and high stability. The pattern shape of the heat-conducting pattern 400 is not limited to hexagons and can also be circular, triangular, rectangular, polygonal, elliptical, wavy, or any combination thereof; moreover, the heat-conducting pattern 400 can be arranged with different densities, spacings, and layouts (such as arrayed, staggered, honeycomb, or encircling) according to thermal design requirements or usage scenarios, connected to each other or partially connected, to form a uniform and stable heat-conducting network. This network enables rapid heat transfer and achieves even distribution on the contact surface 103, ensuring that both the shoulder and neck areas of the body feel balanced heat conduction when in contact with the shawl. Based on this, the heat-conducting pattern 400 can be designed with different pattern combinations to adapt to regions or user groups with varying requirements for heat flow distribution.

In other embodiments (not shown), the heat-conducting pattern 400 on the contact surface 103 can also be a heat-conducting gasket made of carbon fiber. Carbon fiber has good thermal conductivity, and a heat-conducting gasket made from it can conduct heat. In the heating shawl, this high thermal conductivity ensures that heat is rapidly and evenly distributed to all parts of the shawl. Meanwhile, carbon fiber is characterized by low density and high strength, so a heat-conducting gasket made of carbon fiber maintains a lightweight quality while also offering good mechanical strength and durability. Additionally, the carbon fiber heat-conducting gasket has a certain flexibility, which not only increases the contact area of the heat-conducting surface and improves heat conduction efficiency, but also makes the shawl fit more closely to the body when worn, enhancing comfort and warmth.

In this embodiment, the heat-conducting pattern 400 extends to the connecting part 202, allowing the connecting part 202 to also evenly transfer heat. In an embodiment of the counterweight 203, the counterweight 203 is a far-infrared magnet filled into the hollow connecting part 202. When the heat-conducting pattern 400 transfers heat to the connecting part 202, the far-infrared magnet is heated and emits far-infrared rays. The deep penetrating power of far-infrared rays can reach deep into muscles and joints, enabling the far-infrared magnet to improve joint pain and relieve muscle fatigue. Far-infrared rays can also penetrate deep into the human body, directly acting on painful areas, promoting local blood circulation, accelerating the absorption and dissipation of inflammatory exudates, and alleviating pain.

In other embodiments (not shown), the counterweight 203 can also be mineral sand (quartz sand) or mineral stones (volcanic stones). These particles are round or irregular in shape and are evenly distributed within the connecting part 202 of the heating shawl. These counterweights are fixed in the shawl's counterweight structure through specific processes, forming a counterweight layer. Mineral sand or stones not only have high density but also possess certain heat retention properties, which can assist the heating effect to some extent.

In other embodiments (not shown), the shawl body 100 and the connecting part 202 are provided with a detachable fixing structure. The detachable connection between the shawl body 100 and the connecting part 202 includes snap-button structures or zipper structures, among others. Both structures offer connection stability, ensuring the shawl does not fall off when worn on the body. The detachable connection between the connecting part 202 and the shawl body 100 increases flexibility in use, facilitates installation and removal, saves space, and makes storage convenient.

Specifically, the fixing structure (not shown) is preferably arranged at the corresponding connection positions between the shawl body 100 and the connecting part 202. The installation method of the fixing structure can be sewing, bonding, heat pressing, embedding within the binding layer, or clamping between fabric layers, thereby achieving detachable fixation without significantly increasing thickness; through this detachable connection method, the shawl becomes more convenient during wearing/removal, cleaning, component replacement, or storage, while also reducing localized wear caused by repeated fixation.

In another optional embodiment, the fixing structure can adopt a snap-fit structure (not shown), i.e., a male snap and a female snap are respectively provided at the corresponding positions of the shawl body 100 and the connecting part 202, achieving engagement by pressing and separation by prying or pulling. The male and female snaps can be plastic snaps, metal snaps, or a combination thereof, capable of providing a stable connection force with a relatively small structural size, suitable for scenarios requiring quick opening/closing and a relatively fixed connection position, making the shawl less prone to connection loosening during wear.

In a further optional embodiment, the fixing structure can adopt a clip-on structure (not shown), i.e., a clip hook and a clip slot are respectively provided at the corresponding positions of the shawl body 100 and the connecting part 202, achieving locking by pushing in, sliding in, or rotating into place, and releasing the lock by reverse action. The clip-on structure can provide strong resistance to pull-out, suitable for scenarios requiring higher fixing strength or stable fit during movement, thereby reducing the probability of accidental detachment.

In another optional embodiment, the fixing structure may adopt a strap structure (not shown). Specifically, straps, loops, or fastening holes may be set at the corresponding positions of the shawl body 100 and the connecting part 202, and fixation is completed during use by threading, knotting, or cooperating with fasteners. This structure has a large adjustment range, capable of covering a wider range of size variations, thereby enhancing adaptability to different users or different wearing layer thickness conditions.

Additionally, the fastening structure can also adopt a zipper structure (not shown), i.e., by arranging matching chain teeth and sliders at corresponding positions on the shawl body 100 and the connecting part 202, closure and opening are achieved by pulling the slider. The zipper structure has a continuous connection path and controllable closure length, enabling stable connection over longer edge segments, which helps form a more continuous wrapping contour and reduces local opening gaps. In an implementation of the above embodiment (not shown), magnetic snaps are used to connect the shawl body 100 and the connecting part 202. Magnetic snap connection utilizes the magnetic attraction to secure the connecting part 202 and the shawl body 100 together. This method is quick and convenient, and does not damage the shawl material. Relying on magnetic force and adsorption, it avoids mechanical wear and damage, making the magnetic snaps more durable, stable, and reliable during use.

In an implementation of the above embodiment (not shown), hook-and-loop fasteners are used to connect the shawl body 100 and the connecting part 202. Hook-and-loop fasteners, also known as adhesive strips or sticky tape, consist of a hook side with fine, soft fiber loops and a loop side with stiff, fine plastic hooks. During use, simply pressing the hook side and loop side together achieves adhesion; attachment and separation are simple and quick, allowing for repeated use.

In a further embodiment, the detachable fastening structure may also be a combination of two or more of the above structures, for example, using magnetic attraction for quick positioning and snap-on or engagement structures to enhance locking; or combining hook-and-loop fasteners with strap structures to simultaneously achieve quick fitting and a larger adjustment range. Through combined arrangements, connection reliability can be maintained while improving ease of wearing and removal, adaptability, and ensuring more stable fastening of the shawl under different usage conditions.

In summary, by arranging the heat-conducting pattern 400 on the contact surface 103, the present disclosure enables the heating shawl to distribute heat evenly across the entire shawl, enhancing the heating effect, promoting blood circulation, and effectively relieving muscle fatigue and soreness.

Embodiment 2

The present disclosure provides a heating shawl, including a shawl body 100, inside which a heating element 500 is arranged. The shawl body 100 includes a shoulder part 101 and a neck part 102, with the side of the shoulder part 101 and neck part 102 that contacts the human body being set as a contact surface 103; a heat-conducting layer is arranged on the contact surface 103 to conduct heat for even diffusion; a counterweight is arranged on the shawl body 100 to ensure the contact surface fits closely to the human body.

The difference between Embodiment 2 and Embodiment 1 is that (not shown), the counterweight consists of spherical particles uniformly filled inside the shawl body 100. In this way, the entire shawl body 100 achieves a weight-bearing effect, ensuring that the contact surfaces 103 of the shoulder part 101 and the neck part 102 are able to closely contact the human body, thereby improving the therapeutic heat application effect.

Of course, in this embodiment, to ensure that the hem position of the shoulder part 101 can still closely contact the human body, straps (not shown) may also be provided at the hem position of the shoulder part 101, allowing the shawl body 100 to be fastened to the human body by the straps. This can prevent the shawl body 100 from shaking during user movement, ensuring that the contact surface 103 of the shawl body 100 remains in close contact with the human body.

Embodiment 3

Since the fit state of the shawl with the human shoulder, neck, and back changes with posture, without real-time monitoring and closed-loop control of the temperature in each area, it is prone to localized insufficient heating or localized overheating, thereby affecting therapeutic comfort and safety. Especially in scenarios such as sleep or prolonged sitting, users are more sensitive to temperature fluctuations. If dynamic adjustment cannot be implemented based on usage duration, external ambient temperature, and wearing pressure changes, it may cause discomfort as well as increased energy consumption and insufficient battery life.

As shown in FIGS. 1, 2, 5, and 6, the present disclosure provides a heating shawl with zoned intelligent heating function. The heating shawl includes a shawl body 100, a power supply interface 300, heating elements 500, a sensing module 600, and a control module (not shown). The power supply interface 300 can be a DC input port or a battery connection terminal, used to supply power to the control module and the heating elements 500. The heating elements 500 are arranged inside the shawl body 100, preferably as flexible graphene heating films or equivalent flexible resistive heating structures, and are divided into at least two independently controlled zones, such as a neck heating zone, a shoulder heating zone, and a back heating zone. Each zone can be configured with a drive circuit to achieve independent switching and independent power adjustment.

In this embodiment, the sensing module 600 includes multiple temperature sensors arranged in different heating zones.

To achieve precise control and real-time feedback for the heating shawl, temperature sensors (not shown) are installed in each heating zone of the shawl body 100 to collect temperature information from the corresponding zones and provide feedback signals to the control module. The temperature sensors are preferably positioned at the central area of each heating zone or in key areas with closer skin contact, and are preferably located on the inner side of the contact surface of the shawl body 100, enabling them to more accurately reflect temperature changes in the body contact area during wear. By independently collecting the temperature of each zone, the control module can adjust the power of the heating element in each zone separately, thereby reducing the risk of localized overheating or underheating caused by variations in wearing pressure, posture changes, or differing heat dissipation conditions, making zonal temperature control more stable and safer.

The temperature sensors preferably employ negative temperature coefficient (NTC) thermistors or integrated digital temperature sensor chips; alternatively, equivalent temperature sensing devices such as thermocouples, infrared temperature sensors, or resistance temperature detectors (RTDs) may be selected based on structural constraints and temperature measurement requirements. In one optional embodiment, the temperature sensor is a chip-packaged NTC thermistor (not shown), which is fixed to the inner side of the contact surface of the shawl body 100 by adhesion, heat pressing, or stitching, and is arranged adjacent to the heating element of the corresponding zone to quickly capture local temperature rise during heating, enhancing the control module's responsiveness to temperature changes. In another optional embodiment, the temperature sensor is an integrated digital temperature sensor positioned at the corresponding location of a zone in the shawl body 100 and connected to the control module via a single-wire or I2C communication interface, enabling reliable data transmission and anti-interference sampling from multiple sensors, which facilitates synchronous monitoring and closed-loop control of each zone's temperature by the control module.

In a further optional embodiment, the temperature sensor can also be a flexible thin-film temperature sensor (not shown). The flexible thin-film temperature sensor is integrated on the inner side of the contact surface of the shawl body 100 through printing, lamination, or bonding processes, making the sensor as flexible as the fabric. This allows it to maintain stable temperature measurement performance when the shawl is bent, stretched, or conforms to the curves of the human body, while reducing the foreign body sensation caused by rigid components. Alternatively, the temperature sensor can be a temperature-sensing unit made of conductive polymer composite material. The temperature-sensing unit is arranged in a strip or sheet form on the inner side of the contact surface of each zone, and its resistance value changes with temperature. The control module acquires its resistance variation through a sampling circuit and converts it into temperature data, thereby achieving real-time temperature monitoring. Through the aforementioned different forms of temperature sensor arrangements, while meeting the requirements of flexible wear and reliable temperature measurement, the accuracy and stability of zoned temperature control can be improved, providing foundational data support for subsequent independent power adjustment per zone, overheating protection, and energy consumption optimization.

Figure 12:
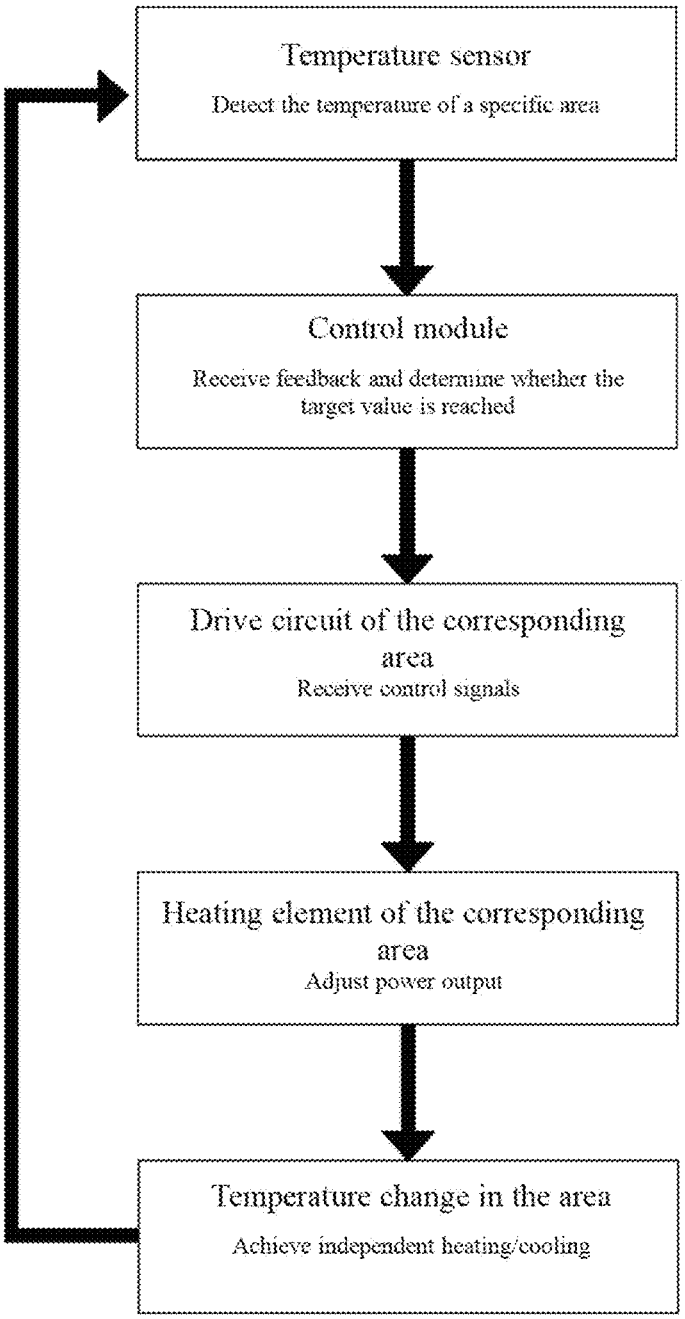
FIG. 12 is a schematic diagram of the independent temperature control process for different zones in the present disclosure.

Specifically, referring to FIG. 12, the temperature sensor individually detects the temperature of a specific area, primarily benefiting from the zoned heating structure in the heating shawl design. Each heating zone of the shawl (such as the neck part, shoulder part, back part) is equipped with an independent heating element and circuit. Each heating element is controlled by an independent drive circuit, enabling independent switching and power adjustment. When the control module receives the feedback signal from the temperature sensor, it adjusts the power output of the corresponding area's heating element based on the set temperature threshold. For example, when the temperature of a certain area is below the target value, the corresponding heating element increases its power output, while the heating elements in other areas maintain their current power levels. The control module adjusts the power of the heating elements through PWM power modulation or graded current control methods, ensuring that the temperature of each area accurately reaches the target value without being affected by the heating status of other areas.

This zoned heating design enables a more precise temperature control experience while enhancing comfort and safety. In scenarios such as sitting still or sleeping, the user's body temperature and the temperature of the contact area with the shawl change minimally, allowing for relatively stable temperature maintenance. However, as user activity increases, thermal demand also changes, making the advantages of zoned heating particularly evident. The control module (not shown) can flexibly adjust the power and heating rate of the heating elements based on the temperature changes in each zone and the user's activity level. This avoids the high energy consumption of all heating elements operating simultaneously and ensures user comfort.

Meanwhile, to ensure the real-time performance and accuracy of temperature feedback, it is preferable for temperature sensors to adopt digital signal transmission. This is because digital signals have strong anti-interference capabilities and high transmission precision, which can avoid data errors caused by noise interference during analog signal transmission. Specifically, the temperature sensor (such as an NTC thermistor) converts the sensed temperature value into a corresponding electrical signal, which is then transformed into a standard digital signal through a digital conversion module. Subsequently, the data is transmitted via a communication protocol (such as I2C or SPI) with the control module (not shown in the diagram). The advantage of using the I2C protocol is that multiple sensors can share the same communication line, and the transmission speed is moderate, making it suitable for low-power systems. For higher-speed data transmission, the SPI protocol can be chosen, as it offers lower latency and faster transmission rates. After receiving the temperature data, the control module will perform corresponding temperature adjustments and power regulation according to the preset temperature control strategy.

In other embodiments, in the design of the heating shawl, power regulation of the heating element is achieved through PWM (Pulse Width Modulation) power control. PWM is a technique that controls power output by adjusting the duty cycle of the current signal. The duty cycle refers to the proportion of time the signal is at a high level (switch on) within one cycle, usually expressed as a percentage. The power output of the heating element is proportional to the duty cycle; that is, a higher duty cycle results in higher output power, and vice versa. By adjusting the duty cycle of the PWM, the control module (not shown in the diagram) can precisely regulate the power of the heating element, thereby achieving temperature control. Specifically, within each zone, the heating element adjusts the heating intensity by controlling the frequency and duty cycle of the PWM signal based on real-time temperature feedback. For example, when the temperature in the heating zone is below the target value, the control module increases the duty cycle of the PWM, causing the heating element to operate at a higher power state for rapid heating. When the temperature approaches the target value, the duty cycle is reduced to lower the power output, enabling fine temperature adjustment.

For different heating elements, the parameterization of power regulation can also be personalized according to regional temperature requirements and comfort needs. For instance, due to the smaller contact surface of the heating element in the neck part, its power regulation may require a more sensitive and rapidly responsive adjustment strategy. In contrast, the heating element in the shoulder part, with its larger contact surface, can adopt a slower temperature rise process to avoid overheating. By specifically parameterizing the power regulation of different heating elements, it can be ensured that each heating zone achieves the desired temperature range, maintaining comfort while preventing energy waste.

In other embodiments, the control module (not shown) sets temperature thresholds for each zone separately, including a maximum temperature threshold and a minimum temperature threshold. Taking the shoulder part zone as an example, the maximum temperature threshold can be set to a safe upper limit within the range of, for example, 50-60 °C (such as 55 °C), and the minimum temperature threshold can be set to a comfortable lower limit within the range of, for example, 35-45 °C (such as 40 °C). The control module can increase power output when the temperature is below the minimum threshold, and reduce power or enter a maintenance mode when the temperature approaches the target value, thereby achieving a smoother temperature control experience and avoiding the "alternating hot and cold" caused by traditional step-based control.

When the control module (not shown) detects that the temperature of any zone exceeds the maximum threshold for that zone, the control module executes an overheating protection strategy, preferably by immediately cutting off the heating power supply to that zone or reducing the power to a safe level, while simultaneously outputting an alert signal. The alert signal can be output through the display screen, indicator light, or buzzer on the shawl body 100, or it can be sent wirelessly to the application interface of a mobile terminal for notification, thereby allowing the user to promptly become aware of the anomaly and take measures.

In another embodiment, the sensing module 600 further includes an external ambient temperature sensor and a pressure sensor. The external ambient temperature sensor is placed on the outer side of the shawl to obtain ambient temperature values; the pressure sensor is placed at key contact points between the shawl and the human body to detect the wearing pressure or contact pressure distribution of the shawl. In addition to receiving zonal temperature signals, the control module also receives ambient temperature signals, pressure signals, and usage duration information obtained by the system timing module, and performs scenario recognition based on the above information.

In this embodiment, the control module can classify scenarios into at least a sitting scenario, a home leisure scenario, and a sleep scenario. The sitting scenario can be defined as when the pressure signal is stable and sustained for a preset duration, for example, stable pressure lasting ≥30 minutes; the home leisure scenario can be defined as when the pressure shows periodic fluctuations or fluctuations within a preset range, for example, fluctuation amplitude of 1-3 N; the sleep scenario can be defined as when the pressure is stable and sustained for ≥60 minutes and the ambient temperature is below a preset threshold, for example, ambient temperature ≤18-22 °C. After recognizing different scenarios, the control module respectively defines the target temperature ranges and heating strategies for the neck part zone and the shoulder part zone.

For example, in an office sitting scenario, the control module sets the target temperature for the neck part to, for instance, 42-48 °C, and for the shoulder part to, for instance, 40-46 °C, to provide a continuous and relatively stable heat therapy experience. In a home leisure scenario, the control module can appropriately increase the target temperature or the heating rate for the neck part or shoulder part to accommodate increased heat dissipation due to frequent posture changes. In a sleep scenario, to avoid discomfort from prolonged high temperatures, the control module can maintain a relatively mild target temperature in the initial stage (e.g., neck 40-44 °C, shoulder 38-42 °C) and, after a period of sustained sleep, implement a gradual cooling strategy, such as reducing the target temperature by about 2 °C per hour until reaching a preset safe and comfortable temperature range, thereby better aligning with the body's thermal comfort needs at night and enhancing safety.

In another embodiment, the pressure sensor may employ a multi-point pressure sensing array or a flexible graphene pressure sensing array, arranged in key contact areas on both sides of the shoulder part and the neck part. By calculating the spatial characteristics of the pressure distribution, the control module obtains characterization parameters such as shoulder width, neck circumference, or neck-shoulder contact surface area, and accordingly classifies users into different body type categories or generates a continuous body type index.

In this embodiment, when the control module determines that the user's body type index is larger (e.g., larger shoulder width, larger contact surface area), it may adopt a more aggressive heating strategy, such as increasing the initial power limit, extending the rapid heating phase, or raising the upper limit of the target temperature for the neck and shoulder partitions (while still not exceeding safety thresholds), so that larger-bodied users achieve a similar perceived temperature rise within the same time as smaller-bodied users, thereby improving adaptability and fairness of experience. Conversely, when a smaller contact surface area or concentrated pressure is detected, it can reduce the heating slope and strengthen hotspot suppression strategies to mitigate the risk of localized overheating.

In another embodiment, the heating shawl also includes a communication module, which can be a Bluetooth, Wi-Fi, or other short-range wireless communication module, used to connect with a mobile terminal application. The mobile terminal application provides functions such as temperature presets, partitioned temperature display, scene mode selection, usage duration statistics, energy consumption/battery life estimation, and abnormal alarm records. Users can set preferred temperature curves, sleep cooling strategy parameters, or target temperature combinations for different scenes in the APP; the control module receives and stores these parameters, executing control in conjunction with real-time sensing data.

In optional embodiments, a voice assistant module may also be added or linked with the voice capability of a mobile terminal to recognize simple control commands, such as "increase temperature," "decrease temperature," "switch to sleep mode," "turn off heating," and may extend to non-core functions like music playback and timed reminders. These extended functions are preferably implemented as subordinate embodiments to avoid interfering with the core temperature control safety logic; the control module must perform safety verification on any external commands to ensure they do not exceed the maximum temperature threshold for each zone or violate the system safety policies.

In further embodiments, the system integrates a flexible graphene pressure sensing array, an infrared temperature sensor, and an acceleration sensor. The flexible graphene pressure sensing array can output pressure distribution information in units of kPa; the infrared temperature sensor can be used for non-contact temperature measurement and to improve skin temperature estimation accuracy (e.g., within ±0.5 °C or ±1 °C accuracy range, which can be determined based on actual selection); the acceleration sensor is used to detect the user's motion state and distinguish between multiple scenarios such as standing, slow walking, and leaning/sitting. Based on the above data, the control module establishes a thermal sensation distribution model of the upper body skin to identify body shape contours, thermal demand intensity, and changes in motion state, and dynamically adjusts zoned target temperatures, heating slopes, and power allocation ratios accordingly.

For example, the user wears the shawl on the shoulder part and neck part and sits still in an office scenario. The acceleration sensor detects that the magnitude of triaxial acceleration change remains below a threshold within a preset time (e.g., no significant step frequency features and low posture change rate for 5 consecutive minutes), and the control module accordingly determines that the user is in a "leaning/sitting/still" state. At this time, the pressure distribution output from the flexible graphene pressure sensing array shows: the effective contact surface area in the neck part region remains stable, with an average pressure of, for example, 2-6 kPa, and the pressure distribution in the left and right shoulder part regions is largely symmetrical with minimal fluctuation; the infrared temperature sensor measures the neck part skin temperature as, for example, 33.5 °C, and the shoulder part skin temperature as, for example, 32.8 °C.

In this scenario, the control module calculates the thermal demand intensity for each area based on a model of thermal sensation distribution on the upper body skin. Since the skin temperature is below the comfortable target range (e.g., 40-46 °C) and the fit state is stable, the model outputs a "continuous stable heating" control strategy. The control module sets the target temperature for the neck part to, for example, 44 °C (or a value within the 42-48 °C range), sets the target temperature for the shoulder part to, for example, 42 °C (or a value within the 40-46 °C range), and sets the heating slope to a relatively gentle slope (e.g., equivalent to a temperature rise of 0.5-1.5 °C per minute). In terms of power allocation, the control module can allocate, for example, 55% of the power weight to the neck part and 45% to the shoulder part; when it detects that the temperature of each partition is approaching the target value, the control module enters maintenance mode (e.g., outputting with a small duty cycle pulse or intermittent output), thereby achieving a thermal therapy effect with smaller temperature fluctuations and a more stable sensation during sedentary scenarios.

When the user transitions from sitting still to walking indoors, the acceleration sensor detects obvious periodic gait characteristics (e.g., the dominant frequency is within the 1-2.5 Hz range, and the triaxial acceleration shows regular oscillations), and the control module determines that the user has entered a "slow walking" state. At the same time, the pressure sensor array shows fluctuations in the contact surface area with intermittent decreases and recoveries, with pressure in the left and right shoulder regions fluctuating, for example, between 1-6 kPa; infrared temperature measurement indicates a trend of the skin temperature dropping or rising slowly within a short period (e.g., the neck part skin temperature decreases from 33.5 °C to 33.0 °C).

In this scenario, the control module determines based on the model: slow walking leads to enhanced heat dissipation and less stable fit, requiring feedforward compensation to avoid a drop in perceived temperature. Therefore, the control module can temporarily raise the upper limit of the target temperature for the neck part (e.g., from 44 °C up to the 45-46 °C range) and increase the power weighting for the shoulder part (e.g., shoulder part from 45% to 55%, neck part adjusted accordingly from 55% to 45%, or raising the total power limit while keeping weightings unchanged), while allowing a faster heating slope (e.g., equivalent to 1-2 °C per minute). When the accelerometer detects that the user has returned to sitting still and pressure fluctuations fall back to a stable range, the control module gradually restores the target temperature, power weighting, and heating slope to the sitting mode parameters, thereby achieving a continuous, smooth temperature control experience of "no temperature drop during movement, no temperature overshoot after stopping."

In this embodiment, the personalized thermal comfort model can be constructed based on a user feature vector, which includes parameters such as body shape index, age coefficient, and activity intensity. The body shape index can be determined jointly by shoulder width/contact surface inferred from the pressure array and user-input weight information; the age coefficient can be entered by the user in the APP or imported with user authorization under compliance; activity intensity can be determined by motion metrics output from the accelerometer. The control module individually adjusts the target temperature range and heating speed according to the user feature vector, enabling different users to achieve a more similar subjective thermal comfort under the same environment and mode. In terms of response speed, the system enables rapid sampling of sensor data and control output updates, thereby achieving more timely temperature adjustments.

In another embodiment, the thermal conduction/heating layer employs a flexible graphene heating film with a hexagonal honeycomb structure featuring multiple independently controlled zones. The honeycomb structure helps form a relatively uniform electrothermal distribution and heat diffusion path while ensuring flexibility. The heating layer is also overlaid with a phase change material energy storage module; the phase change material is preferably paraffin-based, with a melting point of 42-45 °C and latent heat of ≥180 KJ/kg. The phase change material absorbs heat and undergoes phase change when approaching the target temperature, and releases heat when the temperature drops, thereby achieving heat buffering and reducing temperature fluctuations.

In this embodiment, the control module utilizes the heat storage characteristics of phase change material to implement an intermittent heating strategy, i.e., reducing or pausing heating output when the temperature approaches the upper limit of the target range, and resuming output when it nears the lower limit, thereby achieving temperature smoothing through the release of heat from the phase change material. This strategy reduces instantaneous power demand and extends battery life. As an optional example, without phase change buffering, the system's instantaneous power may fluctuate within the 8-12 W range, whereas with phase change material slow release combined with intermittent heating control, the equivalent maintenance power can be reduced to the 3-5 W range (specific values depend on structure, material thickness, and insulation design).

In another embodiment, the control module employs a predictive power allocation algorithm, forecasting changes in thermal demand over a future period based on user behavior patterns and dynamically adjusting power distribution ratios across different zones. Behavior patterns may include historical scenario recognition results, current posture status, environmental temperature trends, and user preference curves. The control module can proactively reduce power when predicting that the user will enter a stable scenario (e.g., prolonged sitting or sleeping) and utilize the thermal inertia of phase change material or a shawl to maintain temperature, thereby avoiding unnecessary high-power output; when predicting that the user will enter a scenario with enhanced heat dissipation (e.g., standing up for activity or a drop in environmental temperature), it can increase preheating output in certain zones in advance to improve sensory continuity.

In this embodiment, the control module can also incorporate a sleep/wake mechanism, entering a low-power sleep state when the user removes the device or when no effective wearing pressure input is detected for an extended period, and resuming operation upon detecting restored wearing pressure or user-initiated wake-up via APP/button. Through such energy management strategies, under constraints such as an 11.1V, 3000 mAh battery, a target of approximately 8 hours of battery life can be achieved (specific battery life depends on materials, insulation, target temperature settings, and environmental conditions, and a finalized range description can be established after validation testing).

Embodiment 4

Referring to FIGS. 1, 3, 5, and 8, the present disclosure also provides a heating shawl, including a shawl body 100, wherein a heating element 500 is arranged inside the shawl body 100. The shawl body 100 includes a shoulder part 101 and a neck part 102, and the side of the shoulder part 101 and neck part 102 that contacts the human body is a contact surface 103. A power supply interface 300 is provided on the shoulder part 101, and the power supply interface 300 is electrically connected to the heating element 500 for supplying power to or charging the heating element 500. A heat-conducting pattern 400 is arranged on the contact surface 103 to diffuse and promote a uniform distribution of the heat generated by the heating element 500 across the contact surface 103, thereby enhancing the comfort of the heat application and reducing the risk of localized overheating. A counterweight structure 200 is provided on the shawl body 100, preferably located in the area corresponding to a hem of the shoulder part 101. The counterweight structure 200 includes a hollow connecting part 202 and a counterweight 203 filled inside the connecting part 202, so that the shawl naturally hangs down and maintains close contact with the human body when worn, reducing lifting or displacement caused by movement, increasing the effective contact area between the heat-conducting pattern 400 and the human body, and thereby improving heat transfer efficiency.

In this embodiment, based on the heating and heat conduction achieved by the shawl body 100, the heating element 500, and the heat-conducting pattern 400, the heating shawl further includes at least one massage module 700. The massage module 700 is detachably arranged on the contact surface 103 to provide a soothing massage function while the shawl heats, thereby enriching the functional diversity of the product.

Specifically, to enable the massage module 700 to be stably installed in a predetermined area of the contact surface 103, several mounting parts are provided along the heat-conducting pattern 400 on the contact surface 103. The mounting parts include several mounting grooves 110 formed on the contact surface 103 and cover members 111 covering the mounting grooves 110. A fastener is correspondingly arranged inside the mounting groove 110, preferably a magnetic component 104. The magnetic component 104 is securely fixed in the mounting groove 110 by strong adhesive, a hot-pressing process, or a sewing fixation structure. The massage module 700 is magnetically attached and positioned to the corresponding magnetic component 104.

Figure 7:
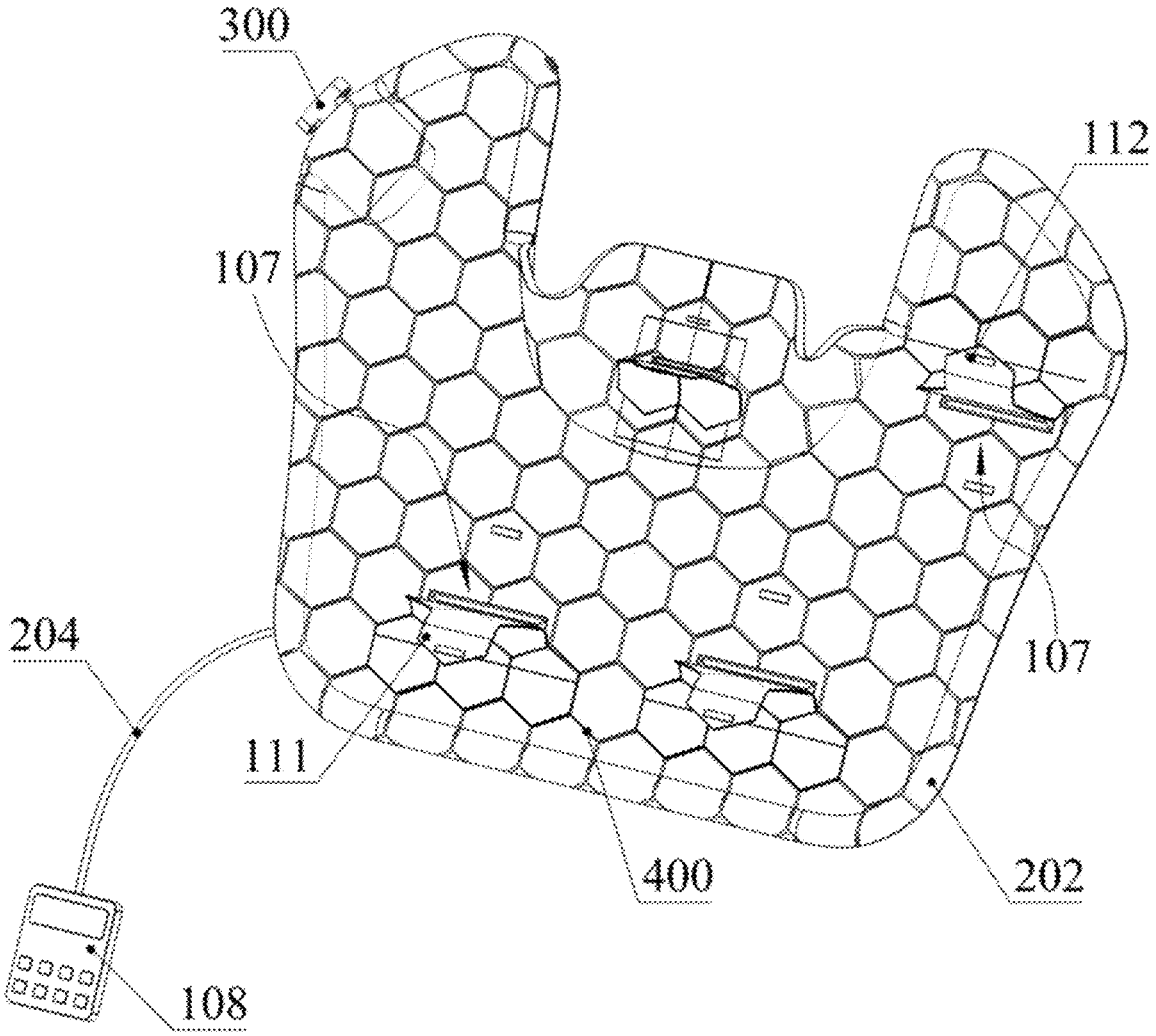
FIG. 7 is a schematic perspective view with the installation cover open in the present disclosure.
Figure 8:
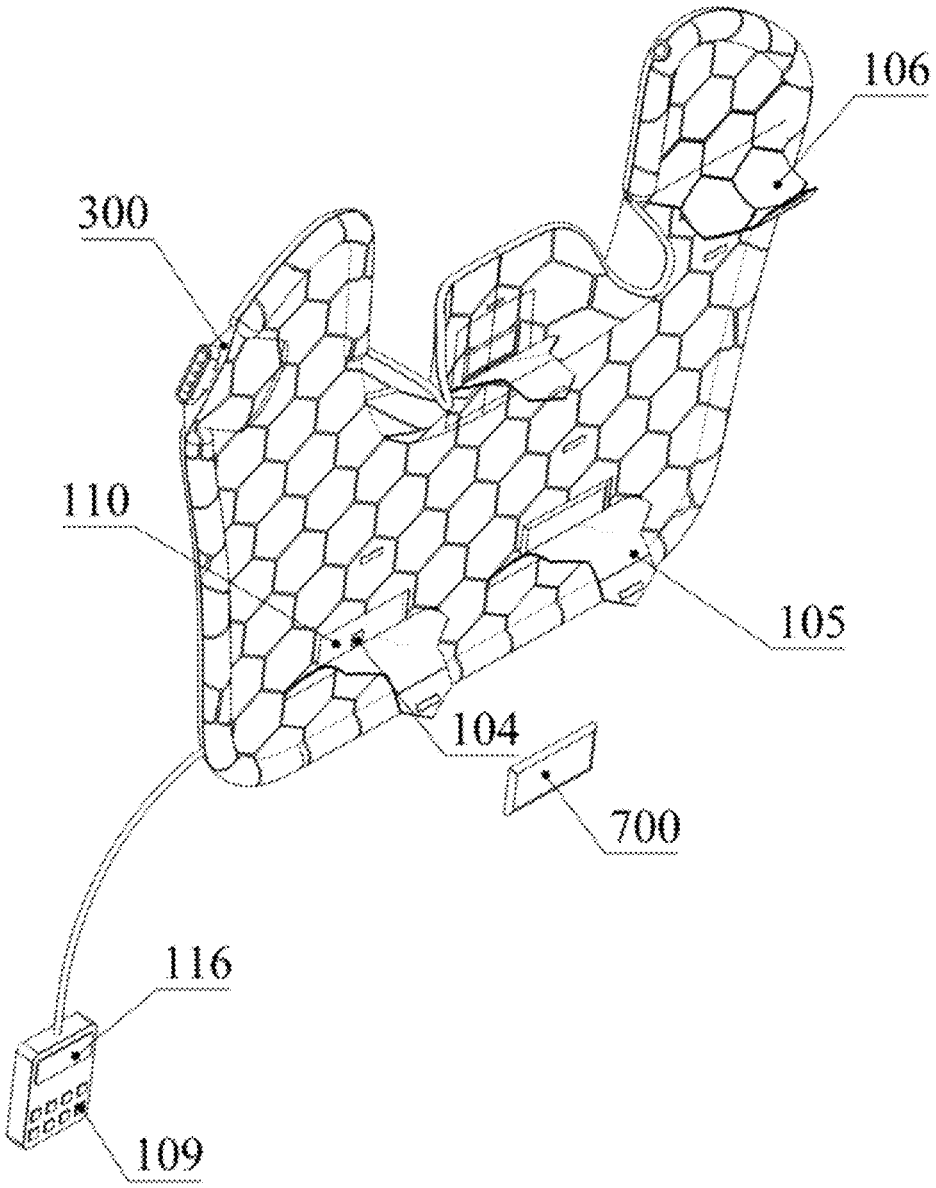
FIG. 8 is another schematic perspective view with the cover member open in FIG. 7 of the present disclosure.

As shown in FIGS. 7 and 8, in a preferred embodiment of the present disclosure, the cover member 111 is of a generally triangular shape, including an upright pocket 105 arranged in a regular triangle and an inverted pocket 106 arranged in an inverted triangle at the hem position of the shoulder part 101. The upright pocket 105 and the inverted pocket 106 respectively cover directly above each magnetic component 104, and an opening 107 is formed between the upright pocket 105, the inverted pocket 106, and the edge of the mounting groove 110. The user can pass the massage module 700 through the opening 107 to install it into the mounting groove 110 and have it fixedly adsorbed by the magnetic component 104; moreover, a hook-and-loop fastener assembly 112 is provided between the upright pocket 105, the inverted pocket 106 at the opening 107 location and the contact surface 103, and they are fixedly connected via the hook-and-loop fastener assembly 112. After the massage module 700 is placed, under the combined action of the enveloping and limiting effect of the upright pocket 105 and the inverted pocket 106 and the magnetic adsorption of the magnetic component 104, the massage module 700 is less prone to loosening, shifting, or falling off during user activities such as turning or raising arms. Simultaneously, the upright pocket 105 and the inverted pocket 106 can also reduce direct friction between the massage module 700 and the skin, improving wearing comfort and lowering the risk of external foreign matter entry.

In other embodiments of the present disclosure (not shown), to make the installation method of the massage module 700 on the contact surface 103 more universal and adaptable to different usage environments, the structure of the magnetic component 104 can also be replaced with a snap structure (male/female snap), a buckle structure, or an adhesive fastener structure (hook-and-loop fastener); specifically, a female snap/buckle base/loop side of hook-and-loop fastener can be sewn or heat-pressed at preset positions on the contact surface 103, and a male snap/buckle head/hook side of hook-and-loop fastener can be set at corresponding positions on the massage module 700. The user places the massage module 700 into the corresponding upright pocket 105 and inverted pocket 106 and then achieves secondary locking by snapping the snaps or adhering the hook-and-loop fastener, thereby enabling quick installation and removal with reliable positioning even in environments requiring no magnetism, needing to avoid magnetic interference, or aiming to reduce costs. Moreover, this can reduce the risk of accidental adhesion caused by the magnetic component 104 attracting nearby metal items, enhancing usage stability.

In other embodiments of the present disclosure (not shown), to improve the coverage reliability of the upright pocket 105 and inverted pocket 106 over the massage module 700 and enhance anti-drop capability, the structures of the upright pocket 105 and inverted pocket 106 can also be replaced with a closed pocket with a zipper, a flap fastening pocket, or an elastic drawstring pocket; specifically, a zipper/flap can be provided at the opening 107 of the upright pocket 105 and inverted pocket 106 and closed with snap buttons or hook-and-loop fasteners, or an elastic drawstring can be sewn into the opening 107 to allow the opening to automatically retract. After the massage module 700 is inserted, higher retention force is formed by zipping or fastening the flap, thereby further reducing the probability of accidental slipping out during prolonged wearing and frequent movement scenarios, and reducing dust and lint from entering the interior of the mounting groove 110, improving durability and cleaning convenience.

Specifically, the opening 107 of the inverted pocket 106 is set on the side facing the shoulder part 101 (see the dashed portion in FIG. 2); when the user wears the heating shawl, the hem of the shoulder part 101 is folded upward along a preset fold line to form a crease, causing the inverted pocket 106 to flip over with the folded hem, thereby orienting the opening 107 of the inverted pocket 106 upward and toward the crease in the worn state, i.e., the opening 107 faces the inner angular area formed by the fold. By positioning the opening 107 opposite the direction of gravity and within the covering/clamping area of the crease, the massage module 700 is less likely to slip out due to shaking during user activity after being inserted into the inverted pocket 106. Meanwhile, the folded hem covers and restricts the opening 107 of the inverted pocket 106, helping to improve the stability and reliability of the massage module 700 installation, and reducing the risk of foreign matter entry caused by direct exposure of the opening 107 of the inverted pocket 106, thereby enhancing wearing comfort and use safety.

Each massage module 700 may include one or a combination of a vibration massage module (not shown), a rolling massage module (not shown), and a magnetic therapy module (not shown). The vibration massage module internally contains a vibration motor, which can output vibrations of different frequencies and intensities to provide soothing experiences; the rolling massage module can create rolling/kneading effects via rollers or eccentric structures; the magnetic therapy module can provide magnetic field effects to enhance the diversity of physiotherapy. Through this modular design, users can select different massage modules 700 according to the needs of different body parts and install them in the upright pocket 105 corresponding to different magnetic components 104, achieving personalized configuration and zoned use.

To ensure stable power supply and signal transmission for the massage module 700, the magnetic component 104 integrates electrical connection terminals (not shown), and the massage module 700 is equipped with corresponding contact structures (not shown). When the massage module 700 is inserted into the upright pocket 105 and magnetically positioned with the magnetic component 104, the contacts automatically align to form an electrical connection, thereby providing a power or control signal pathway for the massage module 700. This avoids issues such as poor contact, loosening, or intermittent power failure that may occur with traditional plug-in connections during flexible deformation, pulling, or shaking of the shawl body, improving operational stability and safety.

Figure 9:
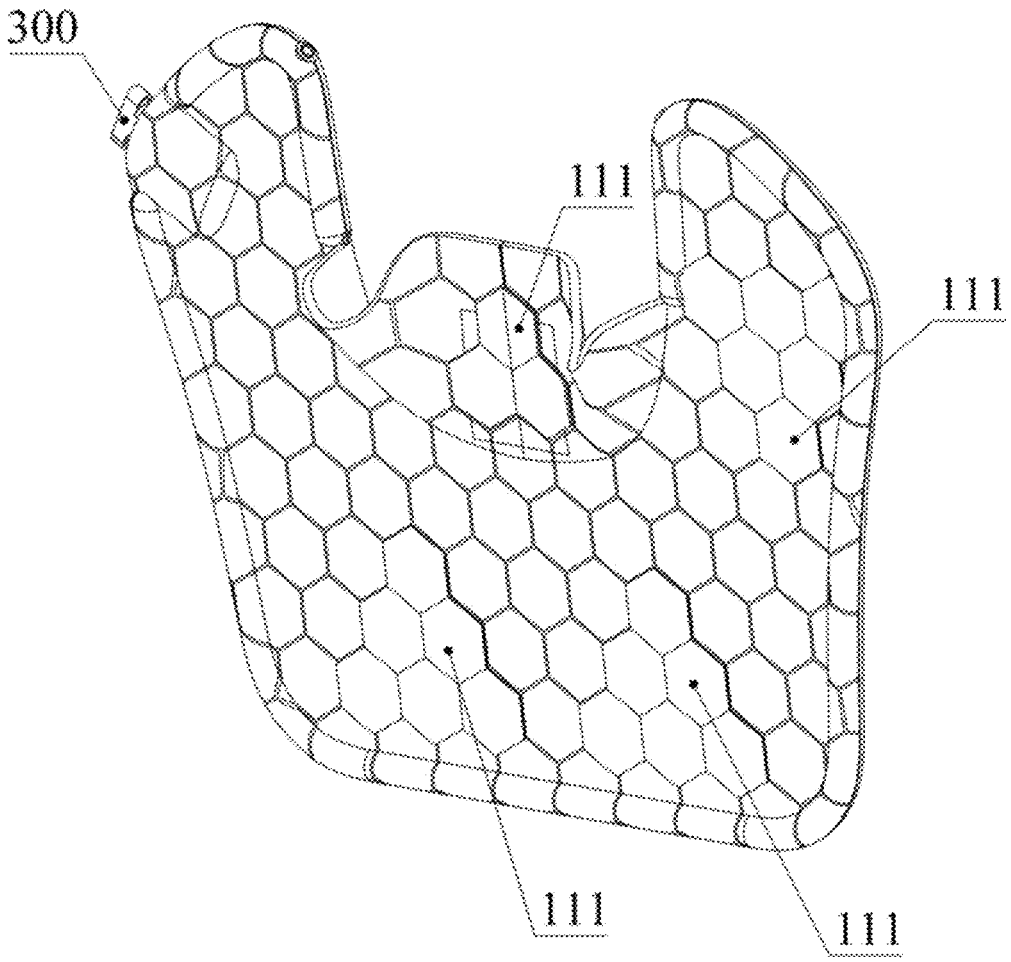
FIG. 9 is a schematic perspective view with the cover member closed in FIG. 7 of the present disclosure.
Figure 10:
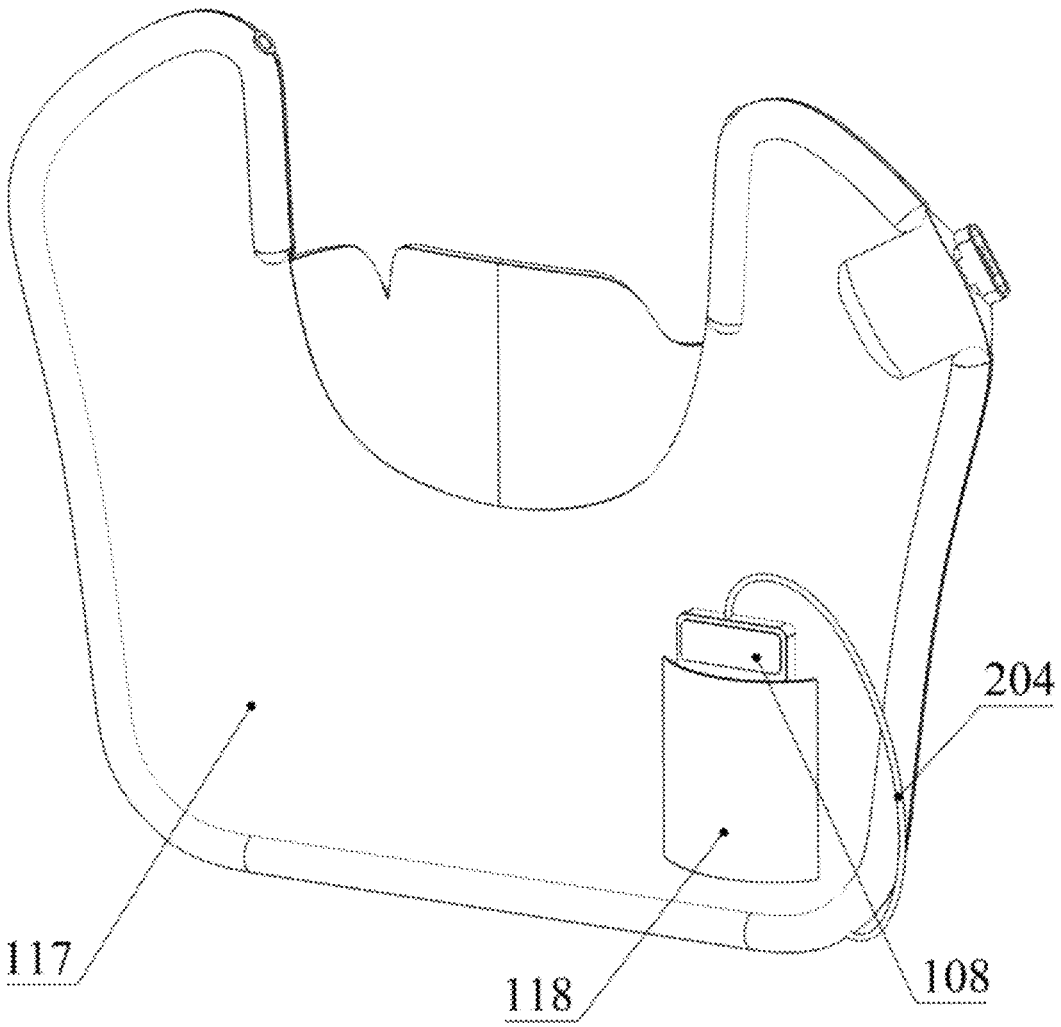
FIG. 10 is a schematic perspective view with the controller stored in the storage bag in FIG. 9 of the present disclosure.

Referring to FIGS. 8, 9, and 10, in this embodiment, the shawl body 100 is also equipped with a controller 108, preferably installed at a position corresponding to the counterweight structure 200 on the hem of the shoulder part 101. For example, the connecting part 202 is provided with a data cable 204; one end of the data cable 204 is fixedly connected to the connecting part 202, and the other end is fixedly connected to the controller 108, reducing cable exposure and enhancing overall aesthetics and reliability. The controller 108 is electrically connected to the heating element 500 and the massage module 700, respectively, to supply power and transmit control signals to them. The controller 108 includes a control button 109 and a display screen 116. Users can adjust the massage module 700's working mode, vibration intensity/frequency, heating temperature level, or target temperature via the control button 109. The display screen 116 displays the current mode, intensity, temperature, and working status information, enabling the heating and massage functions to work in coordination and allowing visual adjustment, thereby improving control convenience and the consistency of the therapeutic experience.

In other embodiments of the present disclosure (not shown), to reduce exposed cables and enhance wearing comfort and long-term reliability, the data cable 204 on the connecting part 202 is eliminated, and the controller 108 is configured as a wireless remote terminal independent of the shawl body 100. Specifically, a control module (not shown) is provided inside the shawl body 100, preferably located within the counterweight structure 200 near the hem of the shoulder part 101 or within the connecting part 202, to facilitate close electrical connection with the power supply interface 300, heating element 500, and electrical terminals of the magnetic component 104; the control module is used to receive control commands and drive control over the heating power/levels of the heating element 500 and the operating modes and intensity parameters of the massage module 700. The controller 108 has a built-in wireless communication unit 114, and the control module has a built-in matching wireless communication unit (not shown). The two establish a communication connection via Bluetooth, 2.4 GHz private protocol, or other short-range wireless methods. The controller 108 generates control commands through the control button 109 and sends them wirelessly to the control module, which then executes the corresponding control strategy upon receipt and can return current mode, intensity, temperature, and operating status information to the controller 108 to drive the display screen 116 for display. Through this approach, the controller 108 can control heating and massage functions without needing a data cable 204 connection to the shawl body 100, avoiding issues such as wire breakage, loosening, and poor contact caused by wired connections during flexible bending, pulling, or storage of the shawl, while also reducing cable interference with human movement and improving overall aesthetics and wearing comfort.

Specifically, referring to FIG. 10, the side of the shawl body 100 not in contact with the human body is the back side 117, which is equipped with a storage bag 118; after the controller 108 is connected to the internal circuit of the shawl body 100 via the data cable 204, once the user has finished wearing it and adjusted the heating temperature and/or massage parameters, the controller 108 can be placed into the storage bag 118 for secure storage, preventing it from dangling, swaying, or colliding with the body or external objects during use, thereby reducing the risk of cable stress and interface loosening due to pulling. Simultaneously, the storage bag 118 provide shelter and protection for the controller 108, minimizing the ingress of sweat, dust and the like, and enhancing overall aesthetics; after product use, the controller 108 can also be stored in the storage bag for easy organization and portability.

What is claimed is:

1. A heating shawl, comprising:

a shawl body having a shoulder part configured to cover and wrap an entire shoulder of a human body and a neck part configured to encircle a neck of the human body, wherein inner sides of the shoulder part and the neck part define a contact surface configured for contacting and releasing heat to the human body;

a counterweight structure arranged at a hem of the shoulder part to keep the hem of the shoulder part vertical and achieve a weight-bearing effect, ensuring that the contact surface of the shoulder part and the neck part is able to closely contact the human body;

a heating element disposed in the shawl body and configured to generate heat;

a heat-conducting pattern disposed at on the contact surface and configured to distribute the heat along the contact surface;

at least one massage module detachably arranged on the contact surface to provide a soothing massage function along the heat-conducting pattern on the contact surface; and a controller electrically connected to both the heating element and the at least one massage module, wherein the controller is configured to control both the heating element and the at least one massage module, coordinate an adjustment of a heating temperature produced by the heating element with an adjustment of at least one of a massage mode, a massage intensity, and a massage frequency of the at least one massage module, and cause the a display to display the heating temperature and the at least one of the massage mode, the massage intensity, and the massage frequency.

2. The heating shawl, as recited in claim 1, wherein the counterweight structure of the shawl body comprises a hollow connecting part disposed at the hem of the shoulder part and a counterweight filled inside the hollow connecting part to maintain the contact surface against the human body.

3. The heating shawl, as recited in claim 2, wherein the counterweight comprises a far-infrared magnet, and the heat-conducting pattern extends into the hollow connecting part, allowing the hollow connecting part to transfer heat.

4. The heating shawl, as recited in claim 3, wherein when the far-infrared magnet of the counterweight transfers heat to the hollow connecting part, the far-infrared magnet is heated and emits far-infrared rays for reaching into muscles and joints of the human body.

5. The heating shawl, as recited in claim 2, wherein the counterweight comprises mineral particles selected from a group consisting of mineral sand and mineral stones and configured to provide weight and retain heat in the hollow connecting part.

6. The heating shawl, as recited in claim 2, wherein the hollow connecting part is detachably connected to a remaining portion of the shawl body by a magnetic positioning member and a snap locking member.

7. The heating shawl, as recited in claim 2, wherein the controller is disposed at the hollow connecting part adjacent to the counterweight, and a data cable operatively connecting the controller to the heating element and the at least one massage module extends through or from the hollow connecting part.

8. The heating shawl, as recited in claim 2, wherein the controller comprises an internal control module disposed in the hollow connecting part adjacent to the counterweight and a remote controller configured to communicate bidirectionally with the internal control module to control the heating element and the at least one massage module and to receive operating-status information from the internal control module.

9. The heating shawl, as recited in claim 1, wherein the at least one massage module is detachably mounted to at least one mounting part provided along the heat-conducting pattern on the contact surface in such a manner that the at least one massage module does not protrude beyond the contact surface toward the human body.

10. The heating shawl, as recited in claim 9, wherein the at least one mounting part comprises a mounting groove recessed inward from the contact surface to define an internal accommodating space, and at least a portion of the at least one massage module is received in the internal accommodating space.

11. The heating shawl, as recited in claim 10, wherein the at least one mounting part comprises a plurality of mounting parts disposed along the heat-conducting pattern on the contact surface, each of the plurality of mounting parts comprising a respective mounting groove recessed inward from the contact surface.

12. The heating shawl, as recited in claim 11, further comprising an upright pocket associated with a first one of the respective mounting grooves and an inverted pocket associated with a second one of the respective mounting grooves.

13. The heating shawl, as recited in claim 12, wherein the inverted pocket is disposed at a foldable shoulder hem, and an opening of the inverted pocket is configured to face a shoulder of the human body when the heating shawl is initially placed on the human body and to turn upward toward a crease formed by the foldable shoulder hem when the heating shawl is worn, such that gravity and the crease resist escape of the at least one massage module received in the inverted pocket.

14. The heating shawl, as recited in claim 11, wherein the at least one massage module is one of a plurality of interchangeable massage modules comprising a vibration massage module, a rolling or kneading massage module, and a magnetic-therapy massage module, the interchangeable massage modules being selectively mountable at different ones of the plurality of mounting parts corresponding to different body zones.

15. The heating shawl, as recited in claim 10, further comprising a magnetic component disposed inside the mounting groove, wherein the at least one massage module is magnetically attached to the magnetic component and positioned in the mounting groove.

16. The heating shawl, as recited in claim 15, wherein the magnetic component is secured inside the mounting groove by a securing technique selected from the group consisting of adhesive bonding, hot pressing and sewing.

17. The heating shawl, as recited in claim 15, further comprising electrical terminals integrated into the magnetic component and corresponding electrical contacts on the at least one massage module, wherein magnetic attachment of the at least one massage module to the magnetic component aligns the electrical contacts correspondingly with the electrical terminals to establish a pathway for power and control signals between the controller and the at least one massage module.

18. The heating shawl, as recited in claim 15, further comprising a pocket associated with the mounting groove and configured to enclose and limit movement of the at least one massage module, the pocket having an opening and a hook-and-loop fastener configured to close the opening, such that the pocket, the magnetic component, and the hook-and-loop fastener retain the at least one massage module at the mounting groove.

19. The heating shawl, as recited in claim 1, further comprising a storage bag disposed on an outer side of the shawl body, wherein the controller comprises a wired controller connected to the shawl body by a data cable and the storage bag is configured to receive the wired controller and at least a portion of the data cable when the wired controller is not being manipulated by a wearer of the shawl body.

20. The heating shawl, as recited in claim 1, wherein the heating element is one of a plurality of heating elements respectively disposed in at least two independently controlled heating zones, the heating shawl further comprises a respective drive circuit and a respective temperature sensor for each of the at least two independently controlled heating zones, and the controller is configured to independently switch and adjust power supplied to each of the plurality of heating elements based on a temperature detected by the respective temperature sensor of the corresponding heating zone.

* * * * *